United States Patent [19]

Messing et al.

[11] 4,431,500

[45] Feb. 14, 1984

[54] SELECTIVE ELECTROPLATING APPARATUS

[75] Inventors: Gilbert S. Messing, Palm Beach, Fla.; Grennady Volkov, Westfield, N.J.; Thomas R. Stanford, Monmouth Beach, N.J.; Jean A. Lochet, Metuchen, N.J.

[73] Assignee: Vanguard Research Associates, Inc., South Plainfield, N.J.

[21] Appl. No.: 502,537

[22] Filed: Jun. 13, 1983

Related U.S. Application Data

[63] Continuation of Ser. No. 330,870, Dec. 15, 1981, abandoned, which is a continuation of Ser. No. 255,295, Apr. 17, 1981, abandoned, which is a continuation of Ser. No. 160,029, Jun. 16, 1980, abandoned.

[51] Int. Cl.[3] ..... C25D 17/00; C25D 17/28; C25D 5/02

[52] U.S. Cl. ..... 204/206; 204/15

[58] Field of Search ..... 205/15, 206–211

[56] References Cited

U.S. PATENT DOCUMENTS

| | | | |
|---|---|---|---|
| 3,539,490 | 11/1970 | Gannoe | 204/207 |
| 3,723,283 | 3/1973 | Johnson et al. | 204/206 |
| 3,819,502 | 6/1974 | Meuldijk et al. | 204/206 |
| 3,855,108 | 12/1974 | Bolz et al. | 204/206 |
| 3,977,957 | 8/1976 | Kosowsky et al. | 204/224 R |
| 4,132,617 | 1/1979 | Noz | 204/206 |

*Primary Examiner*—F. Edmundson
*Attorney, Agent, or Firm*—Weingram & Klauber

[57] ABSTRACT

Apparatus is disclosed for selectively electroplating continuous longitudinally extending stripes or lines onto continuous metal base strip. The apparatus comprises an electroplating station including a rotatable wheel and means for driving said wheel; means for passing said metal strip through said electroplating station by passing said strip about said wheel and moving said strip commonly with said wheel during travel through said station; a stationary flexible electrically insulating mask provided with one or more series of aligned discrete spaced perforate openings, being tensioned against the circumference of said wheel in an arced zone at said electroplating station; said strip passing through said arced zone with the blade thereof nonadjacent the wheel being in sliding face-to-face fluid-tight contact with said tensioned stationary mask; means for rendering said base strip cathodic with respect to a spaced anode; and means for supplying electroplating solution to the side of said mask nonadjacent said base strip as said strip continues to slide in contact with said mask, whereby said solution passes through said mask openings to effect contact and electroplating at stripes extending longitudinally along said base strip, said stripes having a width corresponding to said mask openings.

12 Claims, 5 Drawing Figures

FIG. 4
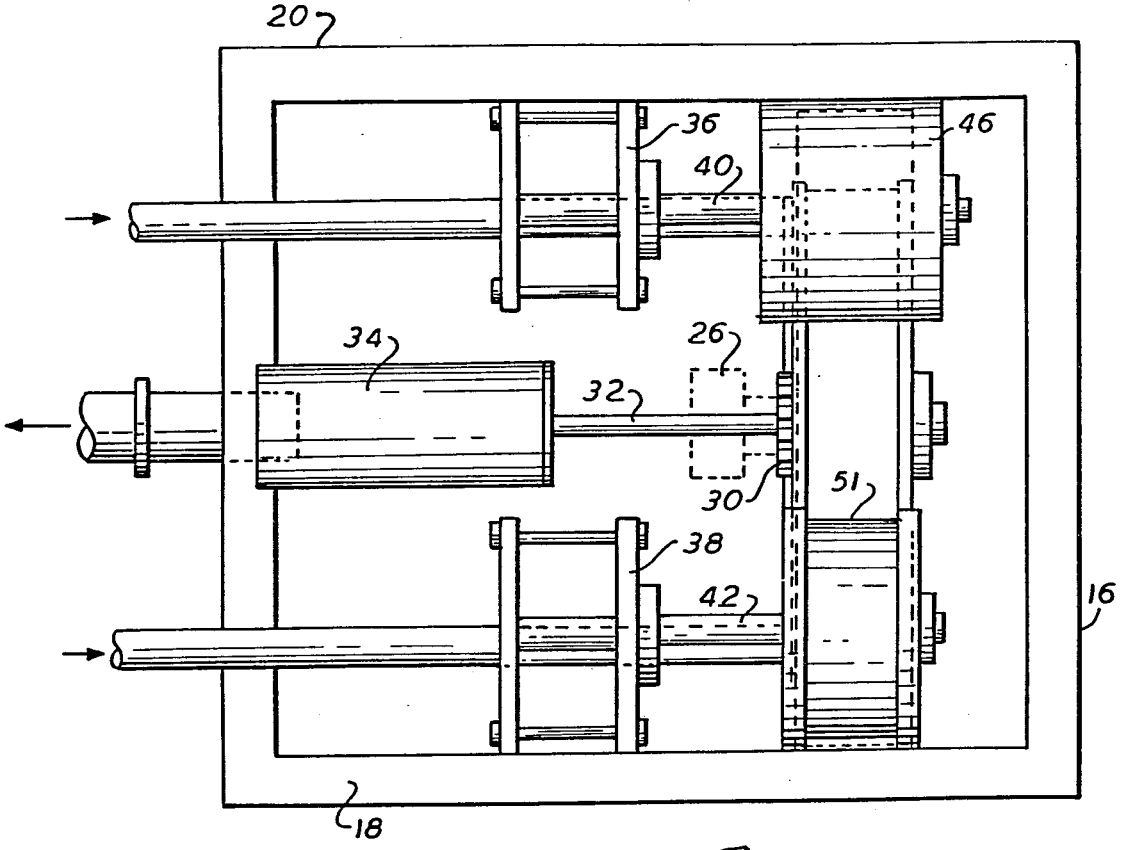
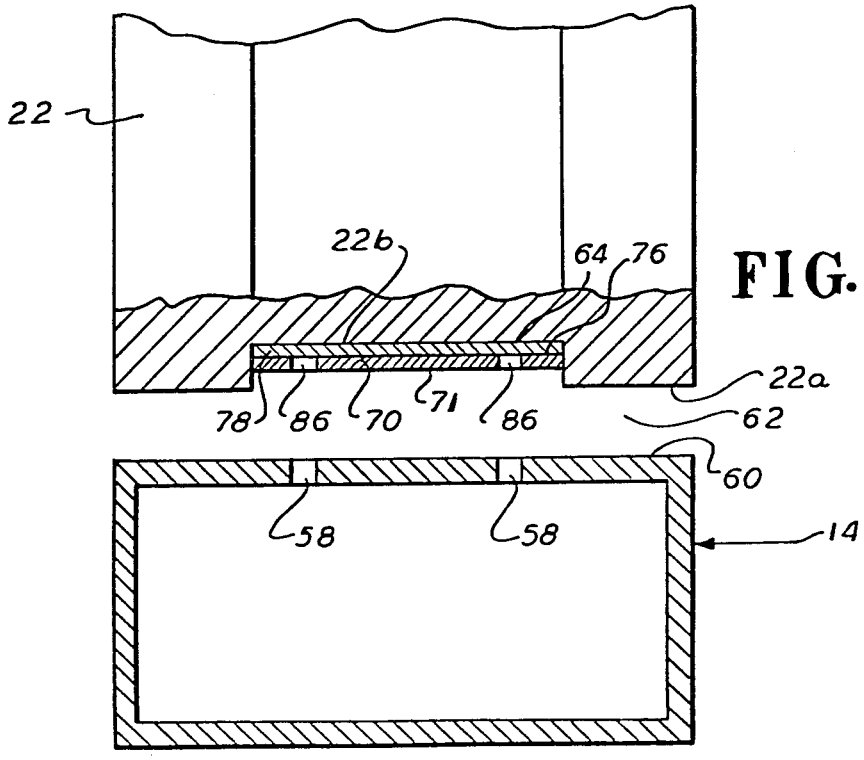
FIG. 3A

SELECTIVE ELECTROPLATING APPARATUS

This is a continuation of Ser. No. 330,870 filed Dec. 15, 1981 and now abandoned, which was a continuation of Ser. No. 255,295 filed Apr. 17, 1981 and now abandoned, which was a continuation of Ser. No. 160,029, filed June 16, 1980 and now abandoned.

BACKGROUND OF INVENTION

This invention relates generally to electroplating apparatus, and more specifically, relates to apparatus useful in selective electroplating of extremely narrow stripes or lines of precious or semi-precious metals onto lengths of metallic base stock.

In numerous applications relating to the fabrication of electronic components, connectors, circuit boards and the like, a requirement exists for electroplating or otherwise depositing onto a base metal such as copper, brass, or the like, a precious metal, notably gold, for the purpose of improving the electrical and wear characteristics of the base metal, at least at the portion thereof where electrical connections are to be effected. Gold is noteworthy for such purposes because of its excellent and uniform electrical interface properties, its relative unalterability, and its high solderability.

At one time, it was relatively common to provide gold electroplating over an entire surface of a base conductor or face of an electronic component such as a header or the like, even though only a very limited portion of the surface being plated was actually intended to receive the electrical connections. Especially, however, because of enormous increases in the cost of gold, commensurate efforts have been made in recent years, to devise apparatus and methods for electroplating the precious metal only onto those portions of the base material whereat the ultimate electrical connections are to be made. The savings which can result from the use of these selective electroplating techniques are relatively enormous.

In one particular type of method for fabricating electronic connectors, a continuous strip of a base material, such as copper, is subjected to a series of punching and forming operations, such that terminal connectors for electrical components are eventually formed toward what was originally the lateral edges of the base strip. For present purposes the important point to note, is that as one aspect of fabrication methods of this type, the continuous metal strip, prior to the punching and forming operations, preferably has deposited thereupon longitudinally extending stripes of a precious metal such as gold. These gold stripes can, for example, extend along the lateral portions of the metal strip, or one or more such stripes can extend longitudinally at positions displaced from the lateral edges. Ultimately, these stripes (or lines) will define the electrical connection areas in the devices which are fabricated from the metal base strip.

It of course, again will be recognized, that one could in principle, plate the entire strip of base stock or one face thereof, etc.; but the consequent use of precious gold would be enormously expensive and wasteful.

In the past, apparatus has been proposed and utilized for achieving results of the type above discussed. For example, a line plating machine is disclosed in U.S. Pat. No. 3,819,502 to Meuldijk et al. Devices of this type usually involve the use of a rotating wheel or the like, which wheel is provided with a circumferentially extending slit through which the electroplating solution is fed from the interior of the wheel. The metal base strip passes about and is carried by the wheel while a plating potential is applied, whereby the strip is wetted through the wheel slit to electrodeposit the desired line or stripe. A somewhat similar arrangement is disclosed in U.S. Pat. No. 3,539,490.

A further approach for electroplating one or more longitudinal metal stripes onto a metal band is described in Dutch patent application No. 7,118,141, which was opened for inspection on July 3, 1973. In this disclosure the band is pulled through a channel defined in a plenum chamber between fixedly spaced flat insulating strips, of which one strip contains apertures for passage of electrolyte. A potential is applied between the band and a spaced anode whereby plating tends to occur in striped zones underlying the apertures. Since the band must move with respect to both spaced insulating strips and since both such strips are fixedly spaced, it is virtually impossible to maintain a fluid-tight seal between the apertured strip and the moving band, in consequence of which it is extremely difficult to maintain definition of the electroplated stripes.

The prior art methods, such as those mentioned above, have been found to be useful, and indeed to reduce the amount of gold which would otherwise have to be electroplated. However, in no known instance have these devices been capable of reducing the width of the line or stripe electrodeposited upon the base strip below about 60 mils. Further, the definition of the stripes has been less than adequate, and certainly less than desired. Indeed, production runs effected with commonly available machines indicate that the best tolerance achievable with non-indexing machines (indexing machines are described in the prior art such as U.S. Pat. Nos. 3,723,283 and 3,977,957), is in the range of 10 to 20 mils. In most cases, the location of a strip can be held within 1 mil or below.

The inability of these prior art devices to hold tolerances, necessitates depositing higher thickness of gold—in order to assure minimum required thicknesses, i.e., since the plated area has a tendency to vary. Furthermore, the inability to hold tolerances obliges one to plate larger surface areas than desired—to assure plating of the required thickness at the desired location.

Pursuant to the foregoing, it may be regarded as an object of the present invention, to provide apparatus for electroplating stripes or lines of precious metal or the like upon a base metal, which electrodeposited stripes or lines may in the practice of the invention be reduced to as little as 15 mils in width.

It is a further object of the invention to provide apparatus as aforesaid, wherein the quality of the electrodeposited material is extremely uniform, and of excellent density, thereby enabling superior electrical connections to be effected to same.

It is a yet further object of the present invention to provide apparatus of the above character, which enables ready variation in the positioning of electroplated lines upon base stock, which enables ready variation in the width of the lines or stripes thereby deposited, and which enables the simultaneous production of a plurality of continuously extending stripes on the base strip. strip.

SUMMARY OF INVENTION

Now, in accordance with the present invention, the foregoing objects, and others as will become apparent in the course of the ensuing specification, are achieved in apparatus which is especially adapted for selectively electroplating continuous longitudinally extending stripes or lines onto metal base strip. Such strip will usually be of a continuous nature, i.e., supplied in the form of reels.

The terms "stripe" and "line" shall be used interchangeably herein, and shall be regarded as equivalents. This despite the fact that in many instances the electrodeposits enabled by the present invention, are of such reduced width that common parlance would be more apt to characterize same as "lines" than as "stripes".

The apparatus of the invention comprises an electroplating station including a rotatable wheel and means for driving said wheel; means for passing said metal strip through said electroplating station by passing said strip about said wheel and moving said strip commonly with said wheel during travel through said station; a stationary flexible electrically insulating mask provided with one or more series of aligned discrete spaced perforate openings being tensioned against the circumference of said wheel in an arced zone at said electroplating station; said strip passing through said arced zone with the side thereof nonadjacent the wheel being in sliding face-to-face fluid-tight contact with said tensioned stationary mask; means for rendering said base strip cathodic with respect to a spaced anode; and means for supplying electroplating solution to the side of said mask nonadjacent said base strip as said strip continues to slide in contact with said mask, whereby said solution passes through said mask openings to effect contact and electroplating at stripes extending longitudinally along said base strip, said stripes having a width corresponding to said mask openings.

The flexible mask may be mounted in an arc extending partially about the circumference of the wheel, whereby the base strip is sandwiched between the mask and the wheel. The wheel is preferably provided with a circumferentially-extending groove which accurately seats and positions the base strip and mask. The sandwiched strip thus moves with the wheel in contact with the periphery thereof, while sliding contact is maintained between the strip and overlying stationary mask. The latter is under tension, by virtue of being secured and drawn at its opposed ends by means spaced from the wheel circumference on opposite sides of the wheel. In consequence of this tensioning action drawing the mask about the arc of the wheel, the sliding contact with the strip which advances with the wheel, is substantially fluid-tight, i.e., liquid electrolyte applied to the side of the mask nonadjacent the base strip can only reach the strip through the perforate openings of the mask.

A sparger surrounds the wheel circumference in at least the portion of same opposed to the arc of the mask. Electroplating solution is supplied under pressure to the sparger, and the sparger surface opposed to the wheel circumference is arced in correspondence to the wheel and slightly spaced therefrom to define with the wheel a curvilinear gap. The wheel, mask, and sparger are mounted in a tank, and electroplating solution therein is normally maintained at a level sufficient to keep same in the curvilinear gap and thus supply such solution to the accessible side of the mask. The curved sparger surface is provided with openings for ejecting electroplating solution into the gap, i.e., toward the adjacent mask; the lines on which the sparger openings are arranged may overlie those of the perforate openings of the mask. The ejected solution from the sparger maintains agitation in the body of electrolyte in the gap, and furnishes fresh solution to assure good plating action. The electroplating solution in the tank may be continuously or otherwise withdrawn, and after filtering and/or replenishing operations, is recirculated back to the sparger.

In practice of the invention, the electroplated lines or stripes thereby generated, can readily be reduced to widths as little as 15 mils, with excellent definition and quality of electrodeposit. The reason for the excellence of the deposit is not fully understood, but it is hypothesized that the movement of the metal surface in its sliding contact past the perforate openings of the mask, tends to generate brushing or shearing at the metal surface during the electrodepositing process, especially since the perforate openings are usually provided as a series of discrete spaced openings disposed along a line. The stripe or line being electrodeposited, is thereby subjected to repeated physical agitation, which, it is believed, tends to reduce or at least impair formation of bubbles or the like, which are known to detrimentally affect the quality of the electrodeposit by causing hydrogen embrittlement and consequent stress.

BRIEF DESCRIPTION OF DRAWINGS

The invention is diagramatically illustrated, by way of example, in the drawings appended hereto, in which:

FIG. 3A is an enlarged detail of the portion of the apparatus in FIG. 3, which is within circle 3A; and FIG. 4 is a top plan view of the apparatus of FIGS. 1 and 3.

DESCRIPTION OF PREFERRED EMBODIMENT

Figure 1:
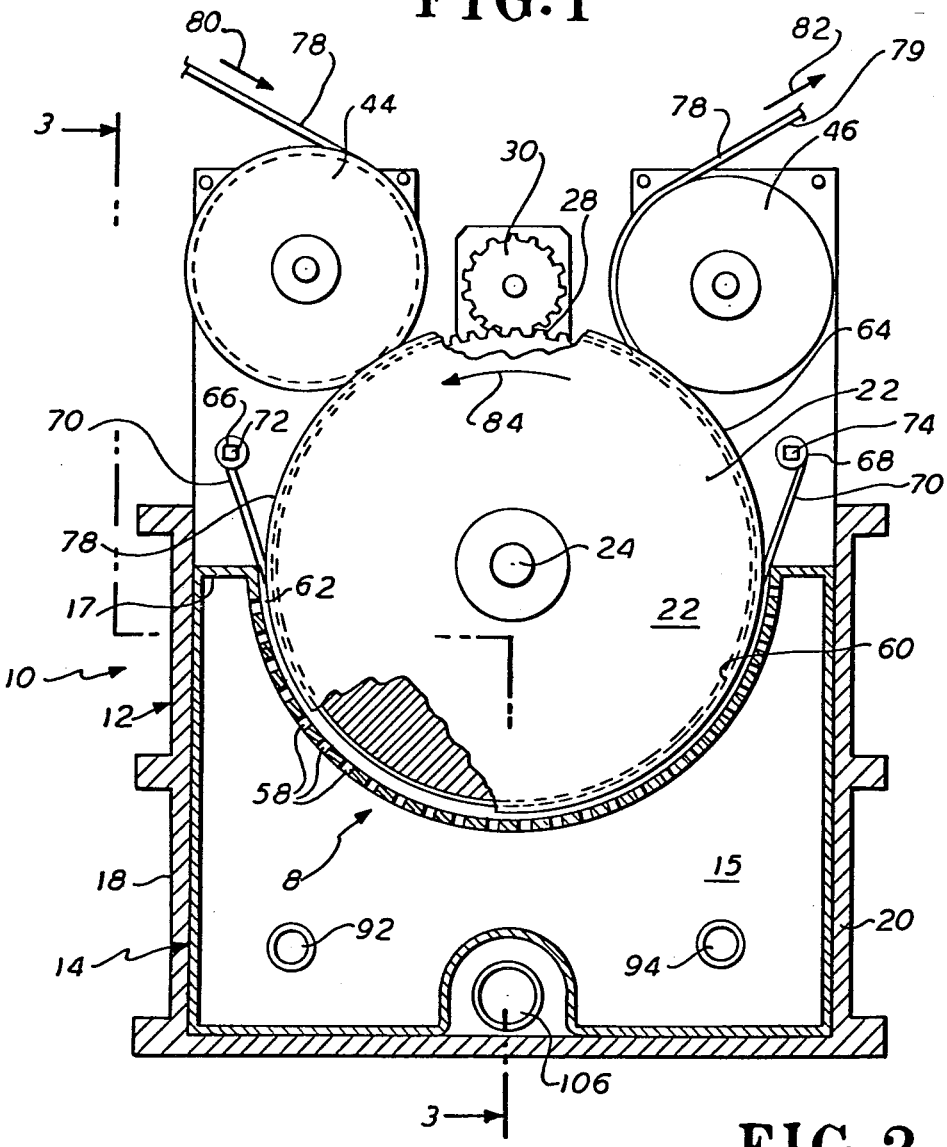
FIG. 1 is an elevational front view, partially sectioned, of apparatus in accordance with the present invention, the said view being taken along the line 1—1 of FIG. 3 herein.
Figure 3:
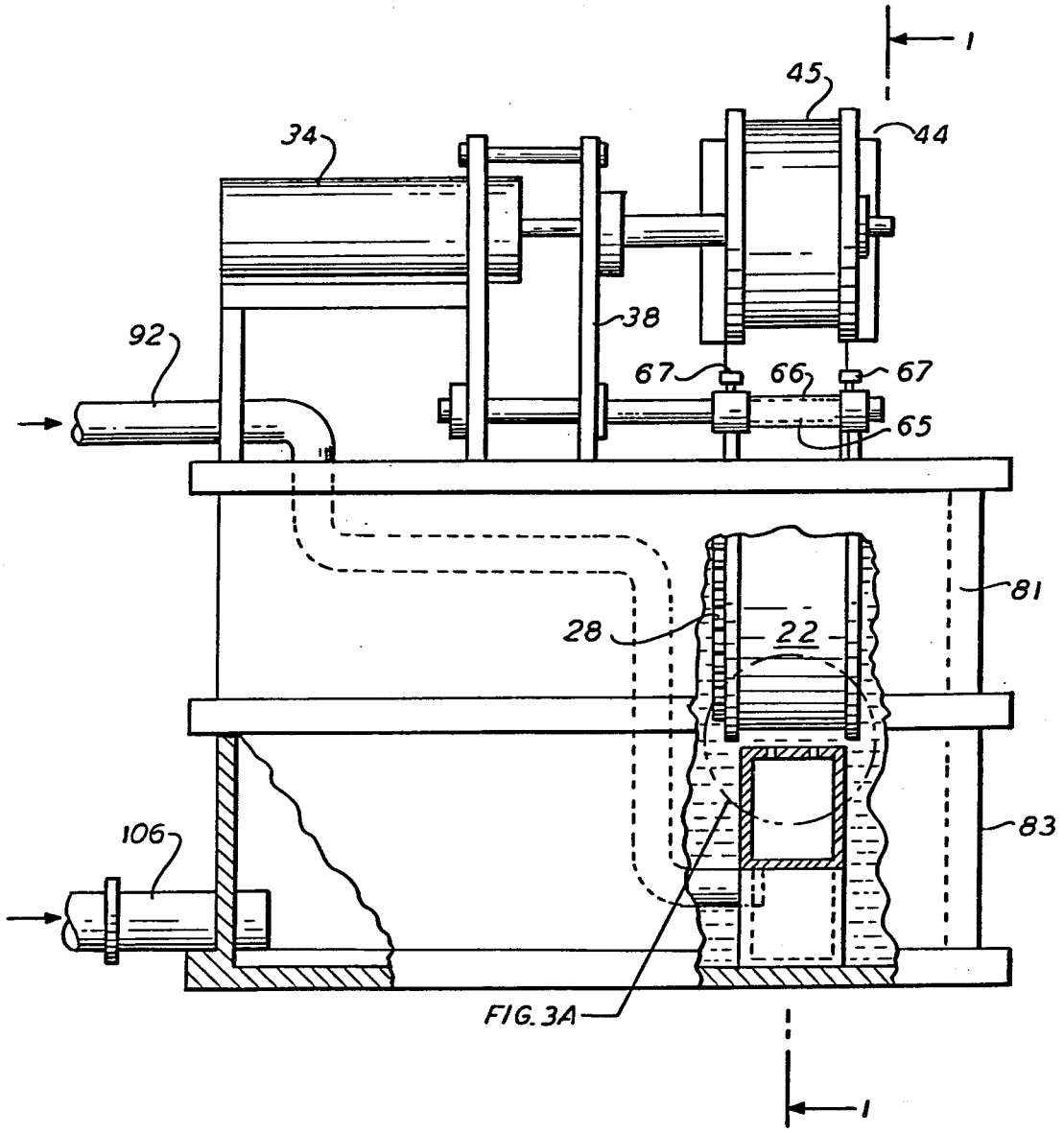
FIG. 3 is a side elevational view, partially sectioned and broken away, of the apparatus of FIG. 1, the said view being taken along the line 3—3 of FIG. 1.

In FIG. 1 herein, a front elevational view appears of apparatus in accordance with the invention, the view being taken along line 1—1 of FIG. 3. FIG. 1 should be considered simultaneously with FIGS. 3 and 4, which respectively depict side elevational and top plan views of the apparatus 10 of the invention.

Apparatus 10 is seen to include a tank 12, toward the forward end 16 of which is mounted a sparger 14, which extends between the two side walls 18 and 20 of the tank. A wheel 22, preferably comprising a plastic material such as Lucite (polymethyl methacrylate) or similar material, is mounted for rotation on an axis 24, which axis is journaled in a support block 26. The rearward face of wheel 22 carries a gear ring 28, which is meshed with a pinion gear 30, the latter being driven by drive shaft 32, which extends to an electric motor 34.

A pair of support blocks 36 and 38 are secured to the side walls 18 and 20 of tank 12. These blocks support shafts 40 and 42, upon which are mounted idlers 44 and 46. Idler 44 can be of one piece plastic or metal construction; and is seen to include a circumferentially-extending groove 45 of reduced diameter. The metal strip, which in use of apparatus 10 passes about idler 44, rests on and is accurately positioned and guided by groove 45—the width of which is appropriate to the width of the strip.

The other idler 46 may comprise smooth surfaced stainless steel or similar material. It is seen that the radii of each of the idlers 44 and 46 are such in relation to the radius of wheel 22 that the idlers are approximately tangent to wheel 22. Actually, the idlers 44 and 46 do not quite touch the wheel 22, as the feed material is intended to pass through the interfaces between the idlers and wheel 22.

It is next seen that sparger 14 is of hollow construction, in order that it might serve as a reservoir 15 for electroplating solution, which is fed through a plurality of openings 58 which are provided at an arcuately formed upwardly facing surface 60 of sparger 14. This surface 60 has a curvature approximately corresponding with the curvature of wheel 22, with the radius of curvature, however, being slightly greater than that of wheel 22, in order that a gap 62 may be defined between surface 60 and the circumferential surface 64 of wheel 22.

Support members 66 and 68 are threadingly received in each of the support blocks 36 and 38—one such member 66 is seen in side view in FIG. 3. These members 66 and 68 serve to anchor and hold under tension a flexible mask 70, further details of which may be seen in the partial plan view of FIG. 2.

More specifically, plastic mask 70, is secured at its two opposed ends by being adhered (by tape or the like) to collars 65 which are rotably fitted on members 66 and 68, with the mask ends then being wound a plurality of times about such collars by lossening the set screws 67 and rotating the collars. The mask is seen between its secured ends to extend through the gap 62 defined between wheel 22 and the arcuate surface 60 of sparger 14. The mask, can be adjusted in tension by loosening set screws 67, and slightly twisting the collars 65 to achieve the desired tension, and thereupon tightening the set screws. Nuts 72 and 74 enable adjustment of the positions of members 66 and 68 with respect to support blocks 36 and 38.

Mask 70, pursuant to the present invention, comprises a thin, flexible dielectric material, preferably a plastic sheet which exhibits a relatively low coefficient of sliding friction with respect to the metal strip, the surface of which is to be slidingly engaged with the mask. A particularly suitable material for mask 70 is a sheet of a polyethylene terepthalate, such as "MYLAR". Other suitable plastics include polytetrafluroethylene (PTFE), such as those materials sold under the trademark TEFLON. Since one of the important functions of the mask is to maintain a fluid-tight seal with the moving metal strip, smooth surface characteristics are important in the mask material—the mentioned MYLAR film is therefore preferably of an optical grade. The dielectric film can typically have a thickness of from 7 to 14 mils—in general it is preferred that the mask be as thin as possible, and yet have adequate strength characteristics. A relatively optimal material is therefore a 7 mil film of the aforementioned MYLAR.

As best seen from the detail view of FIG. 3A, wheel 22 is formed with shoulders **22*a*, and a recessed circumferentially extending groove 22*b*. The width of groove 22*b* only slightly exceeds that of mask 70 and metal strip 78, which assures accurate seating of and proper registration between metal strip 78 and mask 70. It will thus be evident (FIG. 3A) that when mask 70 is placed under tension, i.e., in a taut condition, the face 76 of the mask will be strongly urged toward the adjacent circumferential surface 64 of groove 22*b*, and will thus be brought into contact with any material (such as strip 78) which is sandwiched between wheel 22 and the mask 70**.

Pursuant to the invention, an electroplating station 8 is effectively defined at the gap 62 between mask 70 and wheel 22. A material which is to be processed in apparatus 10, and typically comprising a continuous strip of base stock, usually a continuous strip 78 of copper or the like provided from a feed reel of such material, is fed to the electroplating station 8, as in direction 80. The strip 78 passes about idler wheel 44, thence proceeds about wheel 22, more specifically being received in groove **22*b*, where it is sandwiched between surface 64 and mask 70. These relationships are best seen in the enlarged view of FIG. 3A (mask 70 and strip 78 have been omitted from the broken-away portions of FIGS. 1 and 3 in order that the related portions of apparatus 10 might be clearly seen). The strip 78 thus passes through the gap 62, and thence passes about idler 46, and exits from apparatus 10 at 79, i.e., in direction 82**.

In effecting continuous passage of strip 78 through the present apparatus, the drive of the strip material may be partially effected by external means (not shown), such as winding reels and the like; and in addition, the rate of passage of the strip through apparatus 10 is controlled by the rotation of wheel 22 in direction 84.

It will now be appreciated that during passage of strip 78, through apparatus 10, and in particular, through gap 62, the mask 70 remains at all times stationary; and because it is under tension, the said mask is maintained in face-to-face contact with strip 78, which strip thus slides past the mask during its progression through the apparatus. The mask 70, which is shown in further detail in FIG. 2, as already indicated, comprises a flexible plastic material, which in addition to flexibility, and relative thinness, should have relatively low frictional properties; and indeed, a degree of self-lubrication is desirable in that an essential aspect of the present invention is the sliding contact effected with the stationary mask during passage of the metal strip through the electroplating station. The said mask, further, should have a very smooth surface, in order that the tension at the mask may preserve a fluid-tight contact between the mask and strip 78.

Figure 2:
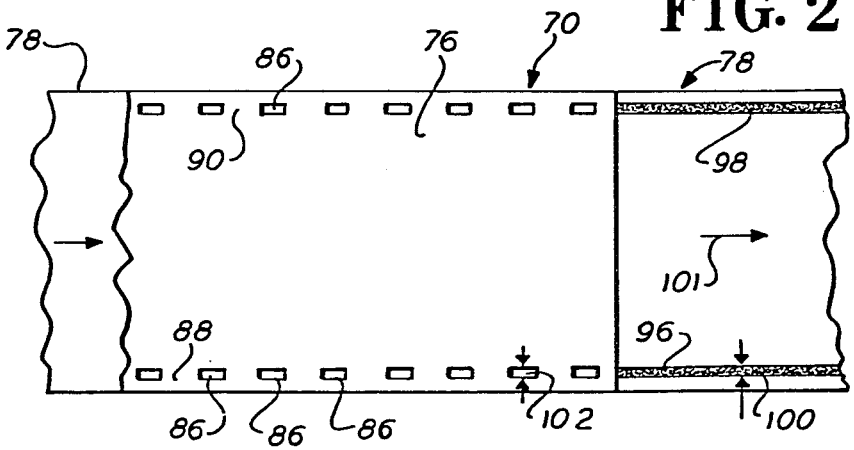
FIG. 2 is a detail plan view, depicting the relationship between the mask and metal workpiece strip, as the latter passes through the apparatus of the present invention.

As seen in FIG. 2, the said mask 70 is provided with a plurality of perforate openings 86, which can be arranged in a series of one or more lines 88, 90, etc. Each of the perforate openings in a given line, is seen to be discrete, and spaced from its neighbor. Any number of such lines 88, 90 can be provided, depending upon the specific needs of the electroplating operation—i.e., on the pattern desired. The various openings 86 at mask 70 are preferably so arranged, and the mask so positioned, that the lines on which these perforate openings reside overlie the lines on which the openings 58 reside, for the underlying arcuate surface 60 of sparger 14 (FIG. 3A). The perforate openings 86 (as shown) are preferably rectangular, in that this encourages sharp definition in the electrodeposited stripes; but openings 86 can also be of circular or of other shape.

With the aid of the foregoing, the operation of the present apparatus may now be fully comprehended. In particular, sparger 14 is seen to be provided with a pair of inlets 92 and 94, through which an electroplating solution, suitable, e.g. for electrode-positing gold, is provided to the sparger. Normally, such solution (or electrolyte) will be furnished by a pump or the like, whereby a positive pressure is established within sparger 14, with respect to atmosphere. In consequence the electroplating solution is ejected under pressure from the openings 58 at arcuate surface 60.

The electroplating solution present in tank 20 is normally at a level approximately corresponding to the top wall 17 of sparger 14. Thus it will be clear that such electroplating solution is also present in gap 62 (FIG. 3A), and is in contact with the side 71 of mask 70 which is non-adjacent metal strip 78.

The electroplating solution thus passes through the stationary mask 70—more specifically, through the perforate openings 86 in such mask. Simultaneously, metal base strip 78, as seen in FIG. 2, proceeds (in direction 101) in continuous sliding fashion, and in face-to-face contact with and past mask 70. In consequence of this arrangement, and in consequence of the fact that the projection of the openings 86 upon the moving strip 78 defines a series of lines, there is electrodeposited upon the moving base strip 78, stripes 96, 98 of the metal (such as gold) which is carried in ionic form by the electroplating solution. Further, the width 100 of the stripes or lines 96, 98, precisely accords with the width 102 of perforate openings 86.

In the absence of ejected solution from sparger 14, the solution is gap 62 would be rapidly depleted of precious metal ion. The continuously ejected solution from openings 58, however, assures good agitation in gap 62 and a plentiful supply of fresh solution. Further, the overlying relationship etween the series of openings 58 and the series of openings 86, provides ejected solution precisely where it will be most effective.

In practice, and as already discussed, the operation of the invention is remarkable, in that it is able to provide well-defined lines or stripes 96, 98, the width 100 of which can be as little as 15 mils.

During the electroplating operation, and as is known in the art, a cathodic potential is provided to the strip 78 to be electroplated. Such potential can be applied to the metal strip 78 at any convenient point, either at the electroplating station, or outside same. Correspondingly, an anodic potential is maintained at some other convenient point in contact with the electroplating solution, as by a means of a wire mesh anode 81, which can comprise platinum and is immersed in the plating solution within tank 12, at a position parallel to the front wall 83 of the tank.

The electroplating solution, after effecting its plating function, is collected by tank 12. Tank 12 is preferably provided with a drain 106 at the bottom thereof, which permits the partially spent electroplating solution to drain from the tank to an external point, where it can be filtered and/or replenished as is known in the art, and subsequently fed back into the sparger 14 via the two inlets 92 and 94. Heating means, again as it is known in the art, may also be utilized either in the tank or external to the same, to maintain the electroplating solution at a desired temperature—in accord with the specific electroplating solution used, and the plating characteristics desired.

The platings yielded by the present invention are found, as mentioned, to be of excellent quality, in addition to possessing highly controlled width. This is thought to partially be a result of the agitation and shearing action of the mask, i.e., the sliding movement of same over the strip being electroplated, together with the excellent agitation provided in gap 62 by sparger 14. The forward and rearward edges of the mask openings (particularly when same are rectangular) also provide additional shearing action as the strip 78 slides past such openings. This shearing action is believed to be promoted by mask 70 being of minimum hickness as is compatible with adequate strength.

It will be appreciated that the depicted apparatus is especially adapted to plating of continuous strip material fed through an arcuate gap. The arcuate geometry, although especially preferred for the present purposes, can be modified for other types of operations, provided that the central inventive concept remains present.

While the present invention has been particularly set forth in terms of specific embodiments thereof, it will be understood in view of the instant disclosure, that numerous variations upon the invention are now enabled to those skilled in the art, which variations yet reside within the scope of the present teaching. Accordingly the invention is to be broadly construed, and limited only by the scope and spirit of the claims now appended hereto.

We claim:

1. Apparatus for selectively electroplating continuous longitudinally extending stripes onto a continuous metal base strip, comprising in combination:

an electroplating station, including a rotatable wheel and means for driving said wheel;

means for passing said metal strip through said electroplating station by passing said strip about said wheel and moving said strip commonly with said wheel during travel through said station;

a stationary flexible electrically insulating mask provided with one or more aligned series of discrete spaced perforate openings, being tensioned against the circumference of said wheel in an arced zone at said electroplating station;

said strip passing through said arced zone with the side thereof nonadjacent the wheel being in sliding face-to-face fluid-tight contact with said tensioned stationary mask;

means for rendering said base strip cathodic with respect to a spaced anode; and means for supplying electroplating solution to the side of said mask nonadjacent said base strip as said strip continues to slide in contact with said mask, whereby said solution passes though said mask openings to effect contact and electroplating at stripes extending longitudinally along said base strip, said stripes having a width corresponding to said mask openings.

2. Apparatus in accordance with claim 1, further including a tank in which said electroplating station is mounted, for holding a reservoir of said electroplating solution in contact with the side of said mask non-adjacent said strip.

3. Apparatus in accordance with claim 2, further including a sparger surrounding said wheel circumference at said arced zone; and means for supplying electroplating solution under pressure to said sparger; the surface of said sparger opposed to said wheel circumference being arced in correspondence to said wheel and being spaced therefrom, to define a curvilinear gap between the sparger surface and the mask and sandwiched underlying base strip; said sparger surface being provided with openings for ejecting electroplating solution into said gap in the direction of said spaced mask, whereby to provide agitation and replenishing of the said electroplating solution in said gap.

4. Apparatus in accordance with claim 3, wherein the openings of said sparger surface reside along lines which overlie the lines along which the perforate openings of said mask are aligned.

5. Apparatus in accordance with claim 3, including means for withdrawing electroplating solution from said tank, and means for recirculating said solution back to said chamber.

6. Apparatus for selectively electroplating continuous longitudinally extending stripes onto a continuous metal base strip, comprising in combination:

a rotatable wheel and means for driving said wheel;

means for feeding said metal strip about the circumference of said wheel, said strip contacting and moving commonly with said circumference;

a stationary flexible dielectric mask provided with a series of discrete spaced openings, being mounted in an arc extending partially about the circumference of said wheel; said mask being tensioned to mechanically bias same toward said wheel circumference and thereby against said metal strip moving with said circumference, to maintain a sliding face-to-face fluid-tight contact between said mask and said strip;

means for supplying electroplating solution to the side of said mask nonadjacent said base strip, whereby said solution passes through said mask openings to effect contact with the surface of said strip at stripes extending longitudinally along said base strip, said stripes having widths corresponding to said openings; and means for rendering said base strip cathodic with respect to a spaced anode in contact with said electroplating solution; whereby to effect electrodeposits at said stripes.

7. Apparatus in accordance with claim 6, further including a tank in which said wheel, mask, and anode are mounted, said tank holding a reservoir of said electroplating solution in contact with said side of said mask non-adjacent said strip.

8. Apparatus in accordance with claim 7, further including a sparger surrounding said wheel circumference in at least the portion thereof opposed to the arc of said mask; and means for supplying electroplating solution under pressure to said sparger; the surface of said sparger opposed to said wheel circumference being arced in correspondence to said wheel and being spaced therefrom, to define a curvelinear gap between the sandwiched mask and strip and said sparger surface; said sparger surface being provided with openings for ejecting electroplating solution into said gap in the direction of said spaced mask, for effecting agitation and replenishment of the electroplating solution in said gap.

9. Apparatus in accordance with claim 8, wherein the said wheel includes a circumferentially extending groove for seating and accurately positioning said sandwiched strip and overlying mask.

10. Apparatus in accordance with claim 6, wherein said mask comprises a flexible plastic having a thickness in the range of from 7 to 14 mils.

11. Apparatus in accordance with claim 6, wherein said mask comprises a 7 mil polyetheylene terephthalate film.

12. Apparatus in accordance with claim 6, wherein said mask comprises a flexible plastic band, the central portion of which is drawn about said wheel circumference; the opposed ends of said band being secured to means spaced from said circumference on opposite sides of said wheel, said means being adjustable to vary the tension of said band to effect said biasing of the mask toward the wheel circumference.

* * * * *